US010224672B2

(12) United States Patent
Suzuki et al.

(10) Patent No.: US 10,224,672 B2
(45) Date of Patent: Mar. 5, 2019

(54) LEVER-TYPE CONNECTOR

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/979,586

(22) Filed: May 15, 2018

(65) Prior Publication Data

US 2018/0331470 A1 Nov. 15, 2018

(30) Foreign Application Priority Data

May 15, 2017 (JP) ..... 2017-096360

(51) Int. Cl.
*H01R 13/60* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62955; H01R 13/62988; H01R 13/62933; H01R 13/62938
USPC ..... 439/157
See application file for complete search history.

(56) References Cited

U.S. PATENT DOCUMENTS

2003/0199184 A1* 10/2003 Martin ..... H01R 13/62944 439/157
2009/0163062 A1* 6/2009 Matsumura ..... H01R 13/62938 439/157
2011/0014805 A1 1/2011 Sakamaki et al.
2014/0242819 A1* 8/2014 Suzuki ..... H01R 13/62977 439/157
2015/0093926 A1* 4/2015 Henmi ..... H01R 13/62933 439/157
2015/0295352 A1* 10/2015 Kim ..... H01R 13/62938 439/157
2016/0149342 A1* 5/2016 Rodriguez ..... H01R 13/62922 439/157

FOREIGN PATENT DOCUMENTS

JP 2009-245609 10/2009

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A lever (22) is formed with first driving portions (27) to move sliders (35) from a connection end position to an unlocking position in the process of rotating the lever (22) from a connection position to a switch position. Second driving portions (28) push the sliders (35) parallel to one another from the unlocking position to a connection start position in the process of rotating the lever (22) from the switch position to an initial position and move away from the sliders (35) as the lever (22) rotates from the initial position to the switch position with the sliders (35) located at the connection start position. Locking portions (33) restrict rotation of the lever (22) toward the connection position by being locked to the sliders (35) with the sliders (35) located at the connection start position and the lever (22) located at the switch position.

8 Claims, 18 Drawing Sheets

LEVER-TYPE CONNECTOR

BACKGROUND

Field of the Invention

The invention relates to a lever-type connector.

Description of the Related Art

Japanese Unexamined Patent Publication No. 2009-245609 discloses a lever-type connector with a housing. A lever is provided on the housing and is rotatable between an initial position and a connection position. A slider is provided in the housing and is movable between a connection start position and a connection end position. A driving portion of the lever and a driven portion of the slider fit together and cause the slider to move from the connection start position to the connection end position as the lever rotates from the initial position to the connection position. A cam pin of a mating connector is pulled into a cam groove of the slider in the process of sliding the slider from the connection start position to the connection end position and connects the mating connector to the housing.

The connection of the housing and the mating connector is started by inserting the cam pin of the mating connector into the entrance of the cam groove with the lever at the initial position and the slider at the connection start position. At this time, a shift of the lever from the initial position toward the connection position, also shifts the slider from the connection start position due to the fitting of the driving portion and the driven portion. Thus, the cam pin cannot be inserted into the cam groove, thereby causing a problem in a connecting operation.

The invention was completed on the basis of the above situation and aims to realize a smooth connecting operation.

SUMMARY

The invention is directed to a lever-type connector with a first housing and a second housing that is connectable to and separable from the first housing. A lever is mounted on the first housing and is rotatable between an initial position and a connection position. A slider is mounted in the first housing and is movable between a connection start position and a connection end position. A cam groove is formed in the slider and is configured to receive a cam follower on the second housing when the slider is at the connection start position. The first and second housings are connected by causing the cam follower to slide in contact with the cam groove in the process of moving the slider from the connection start position to the connection end position. A first driving portion is formed on the lever and is configured to move the slider linearly from the connection end position to an unlocking position before the connection start position in the process of rotating the lever from the connection position to a switch position before the initial position. A second driving portion is formed on the lever and is configured to push the slider from the unlocking position to the connection start position in the process of rotating the lever from the switch position to the initial position and to move away from the slider as the lever is rotated from the initial position to the switch position with the slider located at the connection start position. A locking portion is formed on the lever and configured to restrict rotation of the lever toward the connection position by being locked to the slider with the slider located at the connection start position and the lever located at the switch position.

The lever is rotated from the connection position to the initial position to separate the connected first and second housings. During this time, the first driving portion moves the slider from the connection end position to the unlocking position until the lever reaches the switch position. Additionally, the second driving portion moves the slider to the connection start position according to the rotation of the lever after the slider reaches the unlocking position. Thereafter, when the lever is returned from the initial position to the switch position, the second driving portion moves away from the slider, and the slider is kept at the connection start position. The locking portion is locked to the slider when the lever returns to the switch position, thereby restricting rotation of the lever toward the connection position and keeping the slider at the connection start position without moving. Thus, the cam groove waits at a position to receive the cam follower of the second housing. Therefore, according to the invention, a connecting operation can be performed smoothly.

The cam groove may include an entrance-side inclined portion capable of moving the slider from the connection start position toward the unlocking position by a pressing force of the cam follower when starting connection of the first and second housings and inserting the cam follower into the cam groove. Accordingly, the slider is moved to the unlocking position to make the lever rotatable merely by inserting the cam follower into the cam groove. Thus, an operation of returning the slider to the unlocking position before the insertion of the cam follower into the cam groove is unnecessary.

The cam groove is formed with a force multiplying inclined portion configured to cause the cam follower to slide in contact therewith in the process of rotating the lever between the switch position and the connection position. An angle of inclination of the entrance-side inclined portion to a connecting/separating direction of the first and second housings is smaller than that of the force multiplying inclined portion. Since the force multiplying inclined portion is an area where a large force is applied toward the cam follower from the slider, a force multiplying function is improved as the angle of inclination to the connecting/separating direction of the housings becomes larger. On the other hand, since the entrance-side inclined portion is an area where a pressing force is applied toward the cam groove from the cam follower, the pressing force to the slider can be enhanced as the angle of inclination to the connecting/separating direction of the housings becomes smaller.

The slider may be formed with a separating pressure receiving surface to be pushed by the first driving portion in the process of rotating the lever from the connection position to the switch position and a connecting pressure receiving surface to be pushed by the first driving portion in the process of rotating the lever from the switch position to the connection position. Additionally, the first driving portion is displaceable parallel to a moving direction of the slider between the separating pressure receiving surface and the connecting pressure receiving surface. Accordingly, the first driving portion applies no driving force to the slider in the process of rotating the lever from the initial position to the switch position with the slider located at the connection start position. Thus, the slider can be kept at the connection start position.

An excessive displacement restricting portion may be formed on the lever and may be configured to restrict a movement of the slider at the connection start position toward a side opposite to the connection end position. Thus, excessive rotation of the lever and an excessive movement of the slider can be prevented when separating the first and second housings.

A distance between the second driving portion and a rotary shaft serving as a center of rotation of the lever exceeds a distance between the first driving portion and the rotary shaft. Thus, a long moving distance of the slider can be ensured even if an angle of rotation is small in the process of rotating the lever from the switch position to the initial position.

A line connecting the rotary shaft serving as the center of rotation of the lever and the second driving portion is defined as a virtual pivot line and a line passing through the rotary shaft and parallel to the moving direction of the slider is defined as a virtual reference line. An angle of inclination of the virtual pivot line to the virtual reference line is larger than 45° in the process of pushing the slider from the unlocking position to the connection start position by the second driving portion. Accordingly, a moving distance of the second driving portion in a direction parallel to the moving direction of the slider is longer than a moving distance of the second driving portion in a direction perpendicular to the moving direction of the slider when the second driving portion is rotated in a range where the angle of inclination of the virtual pivot line to the virtual reference line is larger than 45°. Thus, a long moving distance of the slider can be ensured even if an angle of rotation of the second driving portion is small when the lever is rotated from the switch position to the initial position.

A locking recess may be formed in the lever and may have two gentle slopes oblique to a rotating direction of the lever and connected at an obtuse angle. A locking projection may be formed on the first housing and may be configured to be locked to a bottom portion of the locking recess with the lever at the initial position. According to this configuration, the lever can be held at the initial position by the locking of the locking projection and the locking recess. The locking recess is configured by two gentle slopes connected at an obtuse angle so that the locking recess and the locking projection are semi-locked. Thus, workability is good when the lever is rotated from the initial position to the connection position.

DETAILED DESCRIPTION

Figure 1:
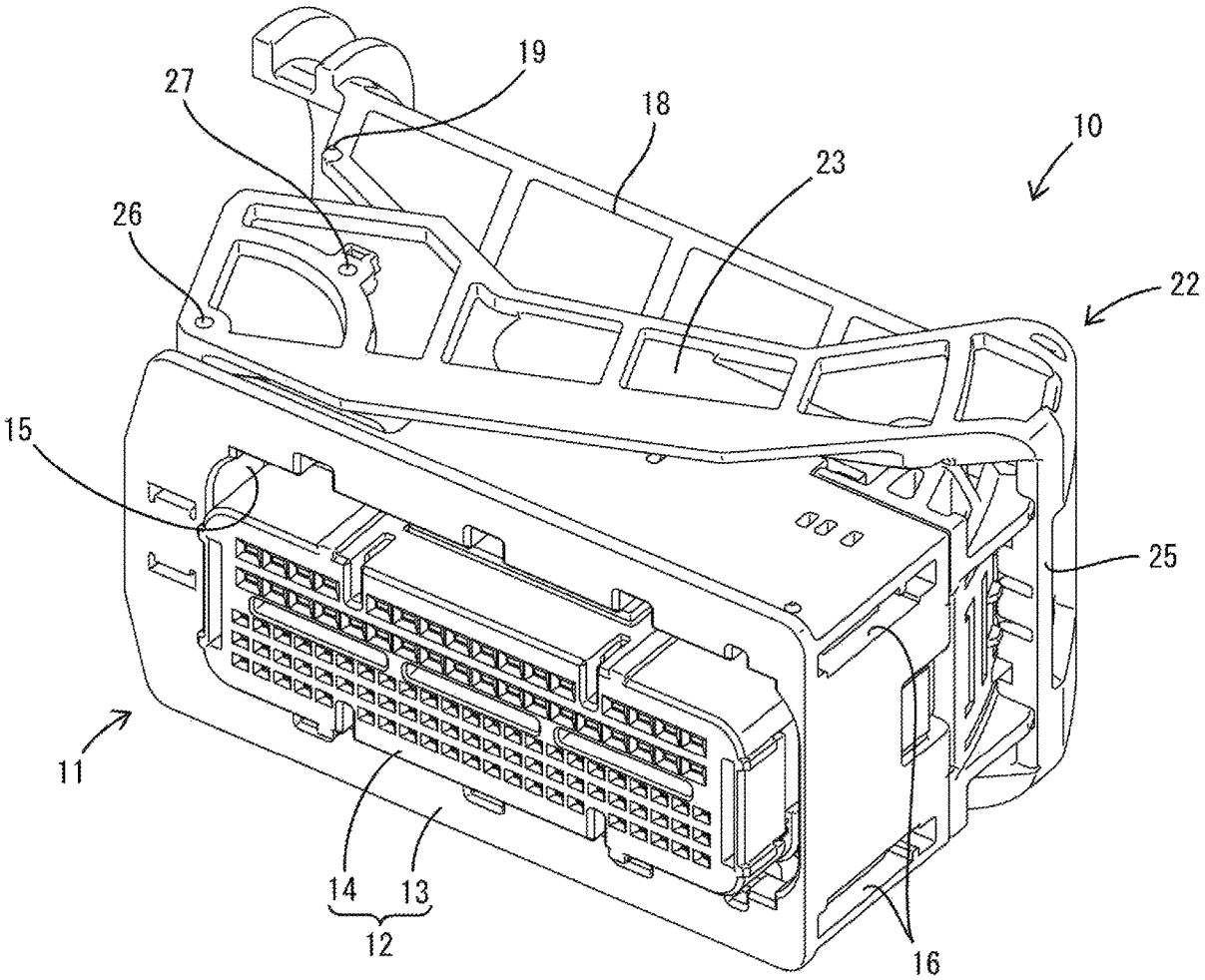
FIG. 1 is a perspective view of a first connector constituting a lever-type connector of an embodiment.
Figure 10:
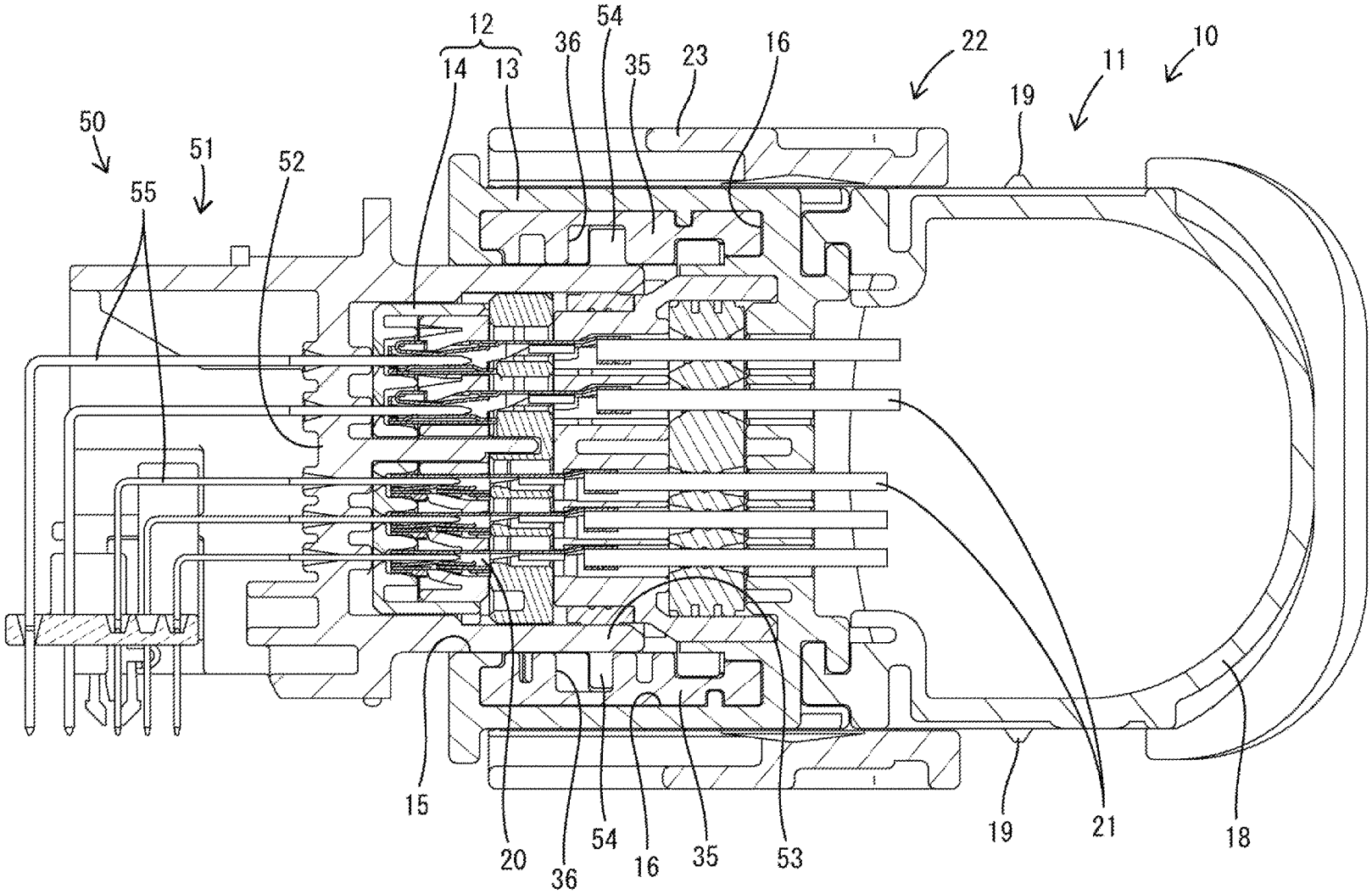
FIG. 10 is a side view in section showing the first and second housings connected.

One specific embodiment of the invention is described with reference to FIGS. 1 to 18. Note that, in the following description, a lower side in FIGS. 2 to 9 is defined as a front concerning a front-rear direction. Left and right sides shown in FIGS. 2 to 9 are defined as left and right sides concerning a lateral direction. Upper and lower sides shown in FIGS. 1 and 10 are defined as upper and lower sides concerning a vertical direction.

A lever-type connector of this embodiment includes a first connector 10 to be mounted on an end part of a wiring harness (not shown) and a second connector 50 to be mounted on the upper surface of a circuit board (not shown). The first connector 10 is connected to the second connector 50 from behind. That is, the first and second connectors 10, 50 are connected and separated by being relatively displaced in the front-rear direction.

<First Connector 10>

The first connector 10 includes a first housing 11 made of synthetic resin, female first terminal fittings 20 (see FIG. 10) mounted in the first housing 11, a lever 22 made of synthetic resin and rotatably mounted on the first housing 11 and two vertically symmetrical sliders 35 made of synthetic resin and slidably mounted in the first housing 11.

<First Housing 11>

As shown in FIGS. 1, 2, 9 and 10, the first housing 11 includes a housing body 12 in the form of a wide block and a wire cover 1. The housing body 12 includes a forwardly open box-shaped outer housing 13 and an inner housing 14 mounted inside the outer housing 13. The first terminal fittings 20 are accommodated inside the inner housing 14. Wires 21 connected to the first terminal fittings 20 are drawn out from the rear of the housing body 12.

A rearwardly open connection space 15 is formed between the inner periphery of the outer housing 13 and the outer periphery of the inner housing 14. A receptacle 53 of the second connector 50 is fit into the connection space 15. The inner surfaces (surfaces facing the connection space 15) of both upper and lower walls of the outer housing 13 are recessed to form two vertically symmetrical guide recesses 16 extending in the lateral direction. Both left and right ends of the guide recesses 16 are open in the outer surface of the outer housing 13.

Two vertically symmetrical bearings 17 (see FIG. 4) are formed on a left end part of the outer housing 13. The bearings 17 are disposed between the guide recesses 16 in the vertical direction and are disposed on a front end part of the housing body 12 (first housing 11) in the front-rear direction. The bearings 17 rotatably support the lever 22.

Figure 2:
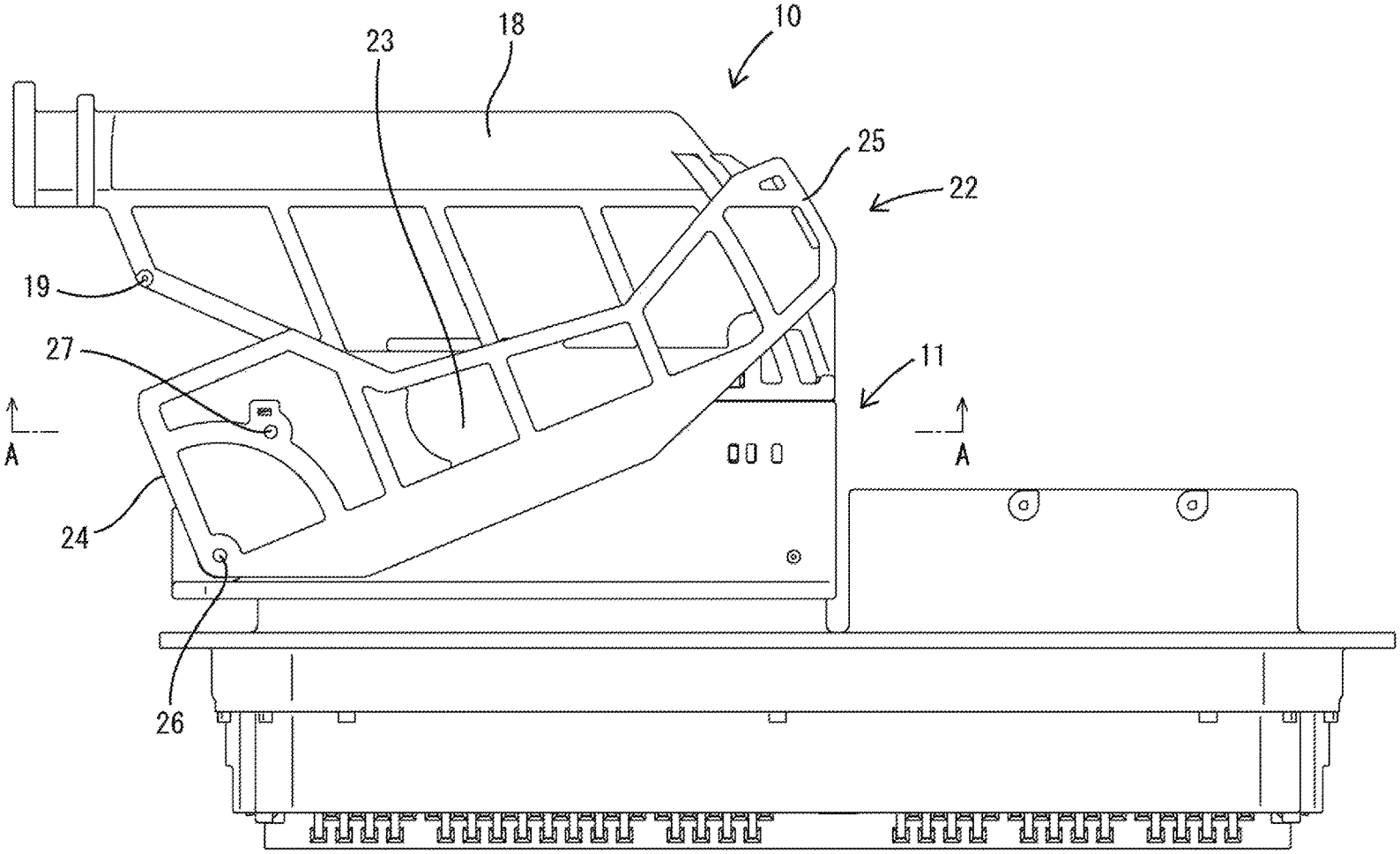
FIG. 2 is a plan view showing a state where the first connector and a second connector are connected.
Figure 3:
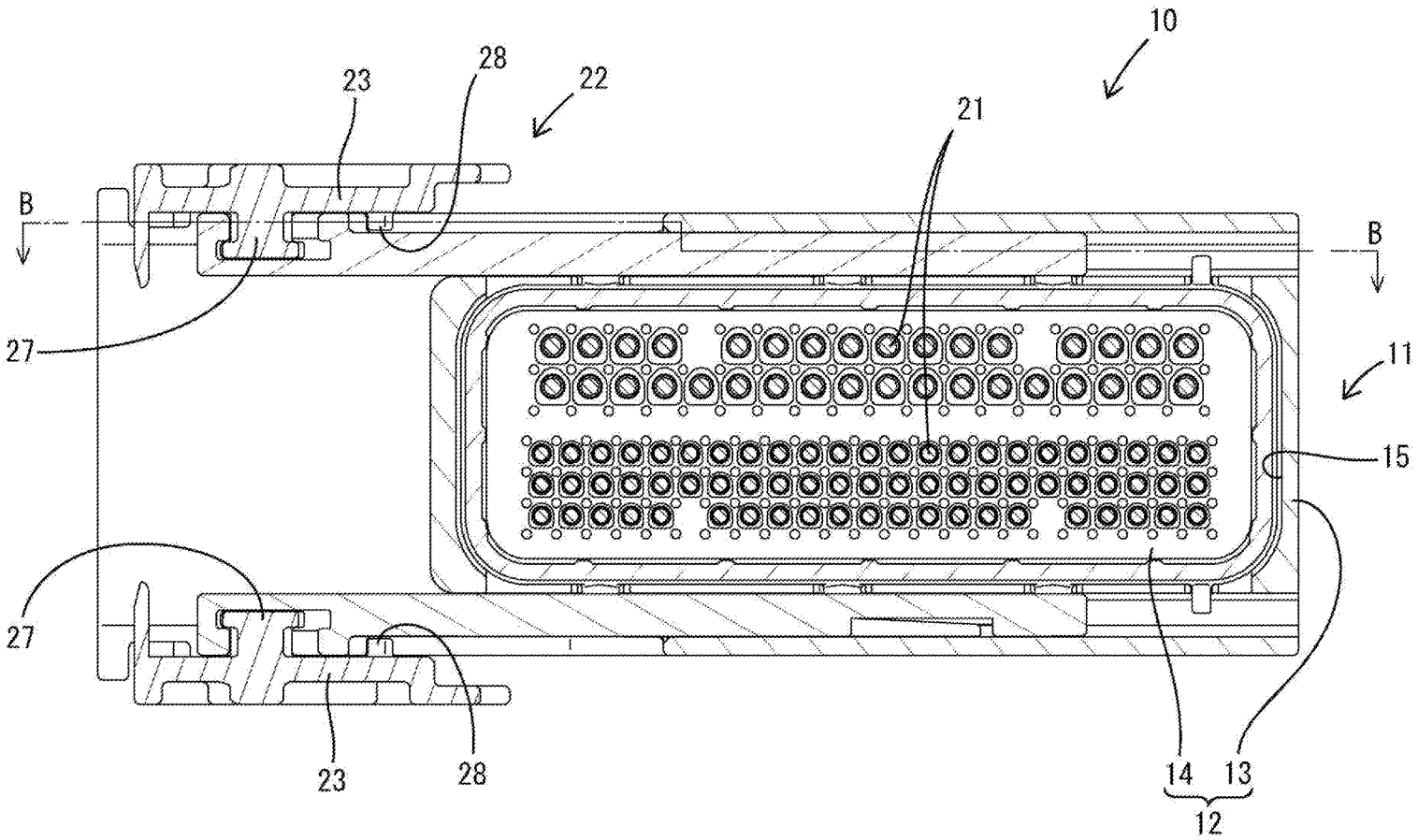
FIG. 3 is a section along A-A of FIG. 2.

The wire cover 18 is mounted on the housing body 12 to cover the rear surface of the housing body 12. The wires 21 drawn out rearward from the rear surface of the housing body 12 are bent to turn leftward inside the wire cover 18. Two vertically symmetrical locking projections 19 (see FIGS. 1, 2, 11, 17 and 18) are formed on upper and lower outer surfaces of the wire cover 18. As shown in FIG. 2, the locking projections 19 are disposed on a left end part of the wire cover 18 (first housing 11).

<Lever 22>

The lever 22 is a single component with two vertically symmetrical plate-like arms 23, a plate-like coupling 24 coupling base ends of the arms 23 and a plate-like operating portion 25 linking tip parts of the arms 23.

Two vertically symmetrical rotary shafts 26 having vertically extending axes are formed on the coupling 24. The lever 22 is mounted on the first housing 11 with the rotary shafts 26 fit in the bearings 17. The lever 22 is rotatable over a range of about 96° between a connection position (see FIGS. 1, 2 and 4) and an initial position (see FIGS. 6 and 9) about the rotary shafts 26. With the lever 22 at the connection position, the rotary shafts 26 are located on a front part of the coupling 24. With the lever 22 located at a switch position or the initial position, the rotary shafts 26 are located on a right end part of the coupling 24.

The operating portion 25 is to the right of the rotary shafts 26 when the lever 22 is at the connection position and is to the rear of the rotary shafts 26 when the lever 22 is at the initial position. The switch position (see FIGS. 5, 7 and 8) is between the connection position and the initial position and is reached by rotating the lever 22 by an angle of about 6° toward the connection position from the initial position.

Two vertically symmetrical first driving portions 27 are formed on end parts of the arms 23 near the coupling 24. The first driving portion 27 is an embossed projection projecting from the inner surface of the arm 23 and having a vertically extending axis. When the lever 22 is at the connection position, the first driving portions 27 are diagonally behind and to the right of the rotary shafts 26. When the lever 22 is at the switch position or the initial position, the first driving portions 27 are diagonally behind and to the left of the rotary shafts 26.

In the process of rotating the lever 22 between the connection position and the switch position, the first driving portions 27 are displaced leftward along a moving direction of the sliders 25 while drawing an arc. In the process of rotating the lever 22 between the switch position and the initial position, the first driving portions 27 are displaced substantially vertically and substantially perpendicular to the moving direction of the sliders 25 while drawing an arc.

Two vertically symmetrical second driving portions 28 are formed on the end parts of the arms 23 near the coupling 24. The second driving portion 28 is an embossed projection projecting from the inner surface of the arm 23 and having a vertical extending axis. A distance from the rotary shaft 26 to the second driving portion 28 is longer than a distance from the rotary shaft 26 to the first driving portion 27.

When the lever 22 is at the connection position, the second driving portions 28 are diagonally behind and to the right of the rotary shafts 26 and diagonally in front of and to the right of the first driving portions 27. When the lever 22 is at the switch position, the second driving portions 28 are substantially right behind the rotary shafts 26 and diagonally behind and to the right of the first driving portions 27. When the lever 22 is at the initial position, the second driving portions 28 are diagonally to the left of the rotary shafts 26 and diagonally behind and to the right of the first driving portions 27.

In the process of rotating the lever 22 between the connection position and the switch position, the second driving portions 28 are displaced oblique to the moving direction of the sliders 35 while drawing an arc. In the process of rotating the lever 22 between the switch position and the initial position, the second driving portions 28 are displaced substantially laterally along the moving direction of the sliders 35 while drawing an arc.

Figure 11:
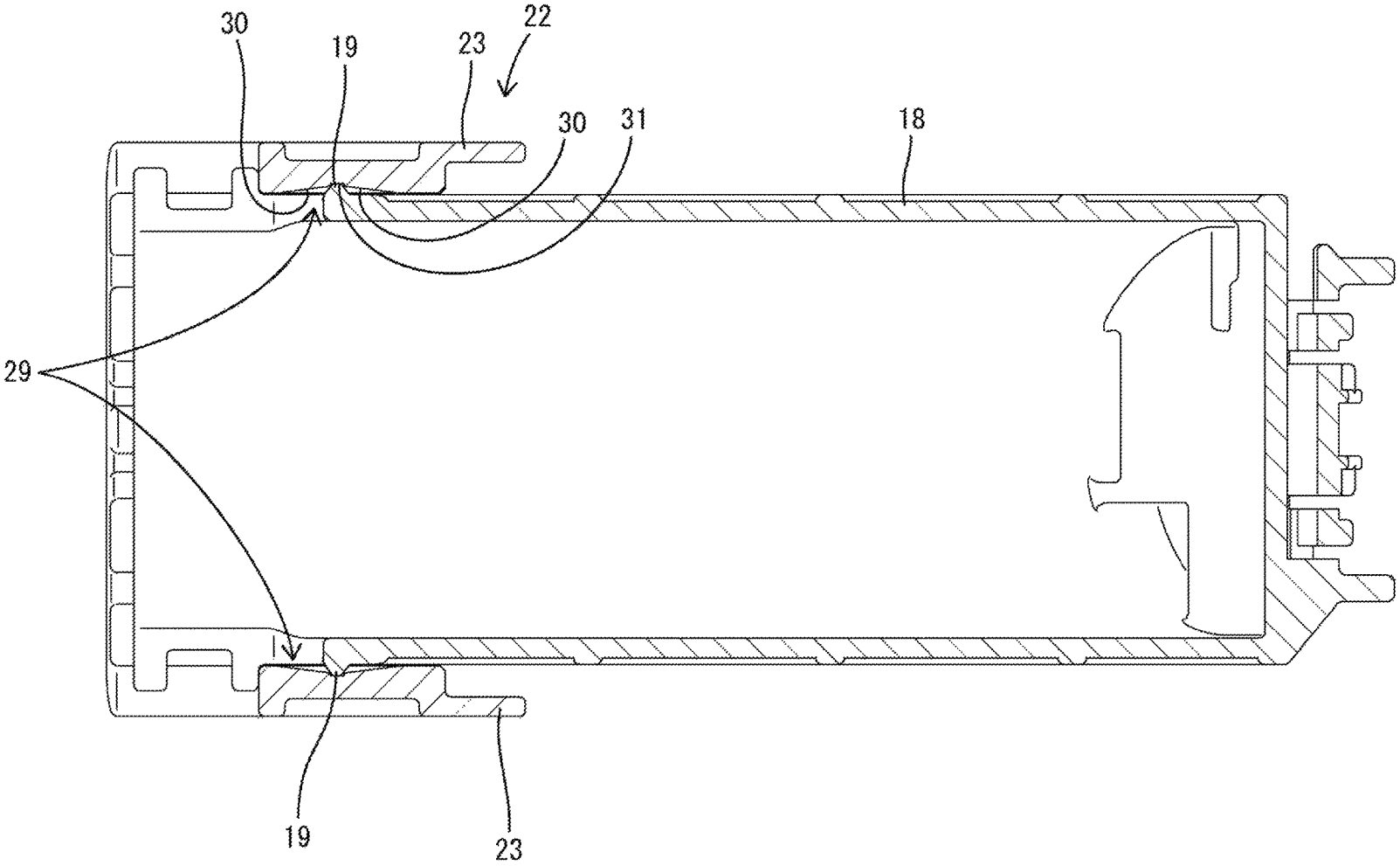
FIG. 11 is a section along C-C of FIG. 9.
Figure 12:
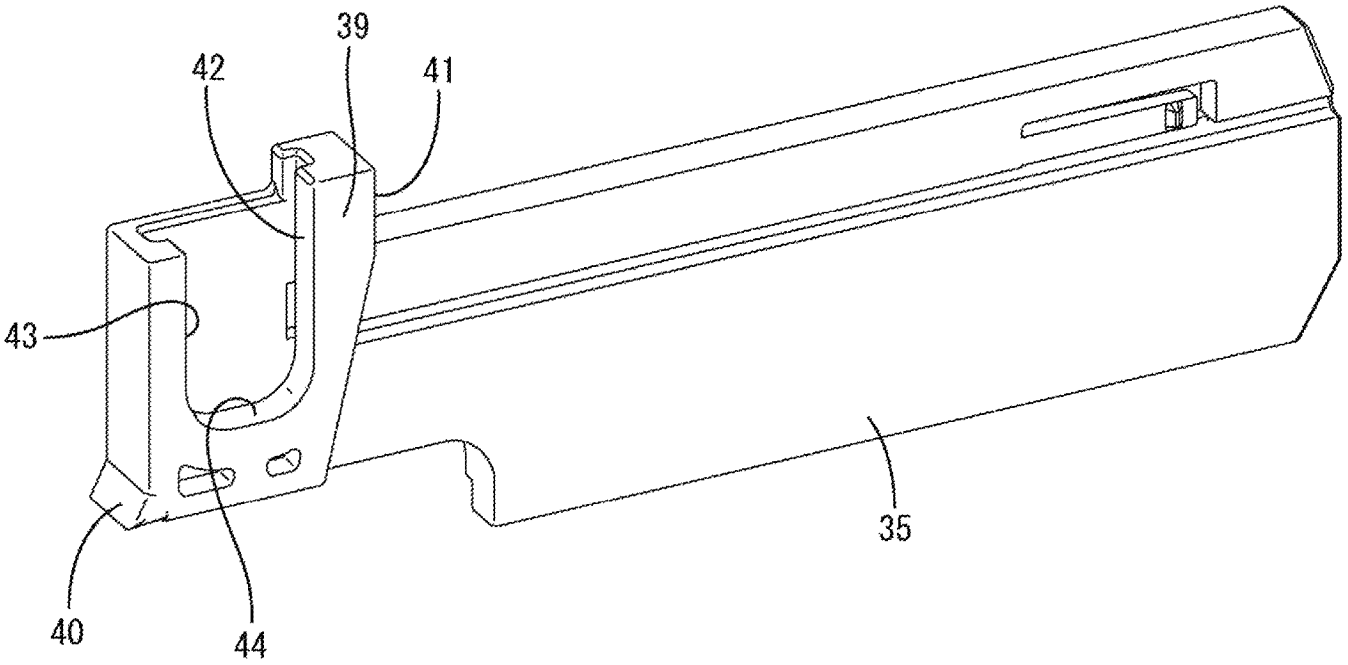
FIG. 12 is a perspective view of the slider.
Figure 13:
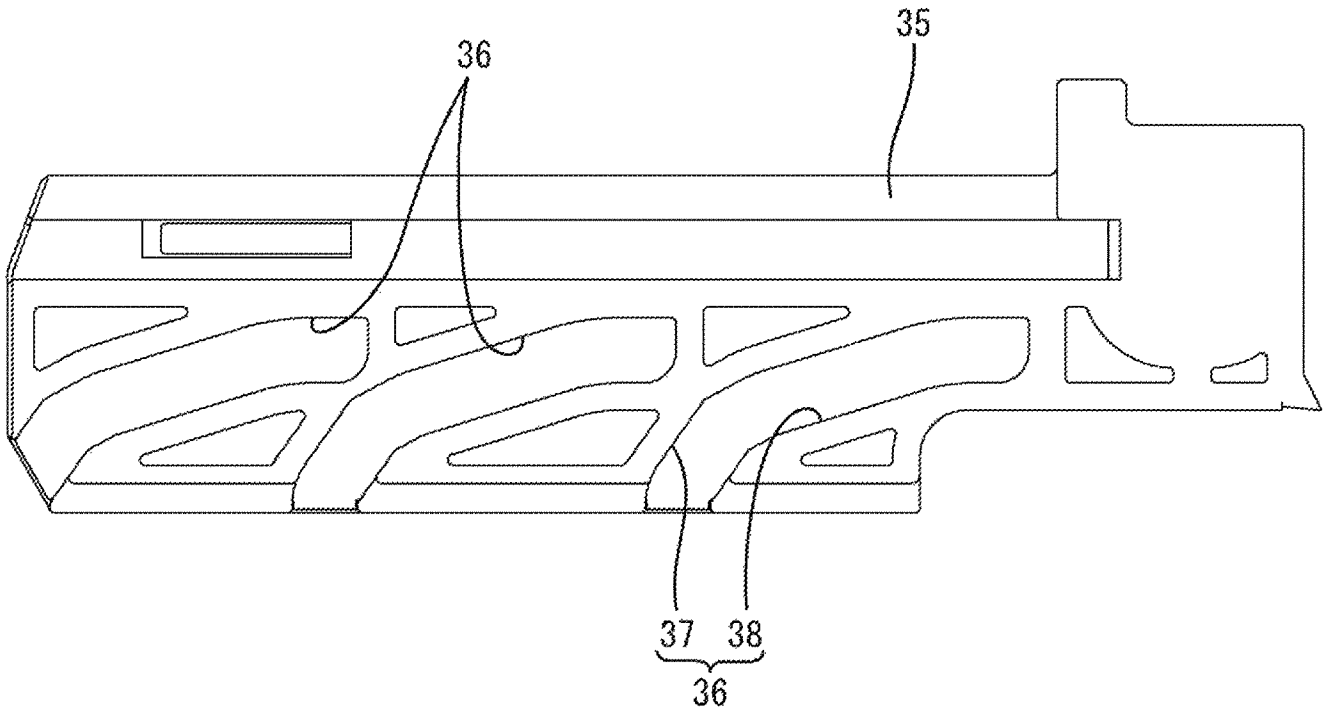
FIG. 13 is a bottom view of the slider.
Figure 14:
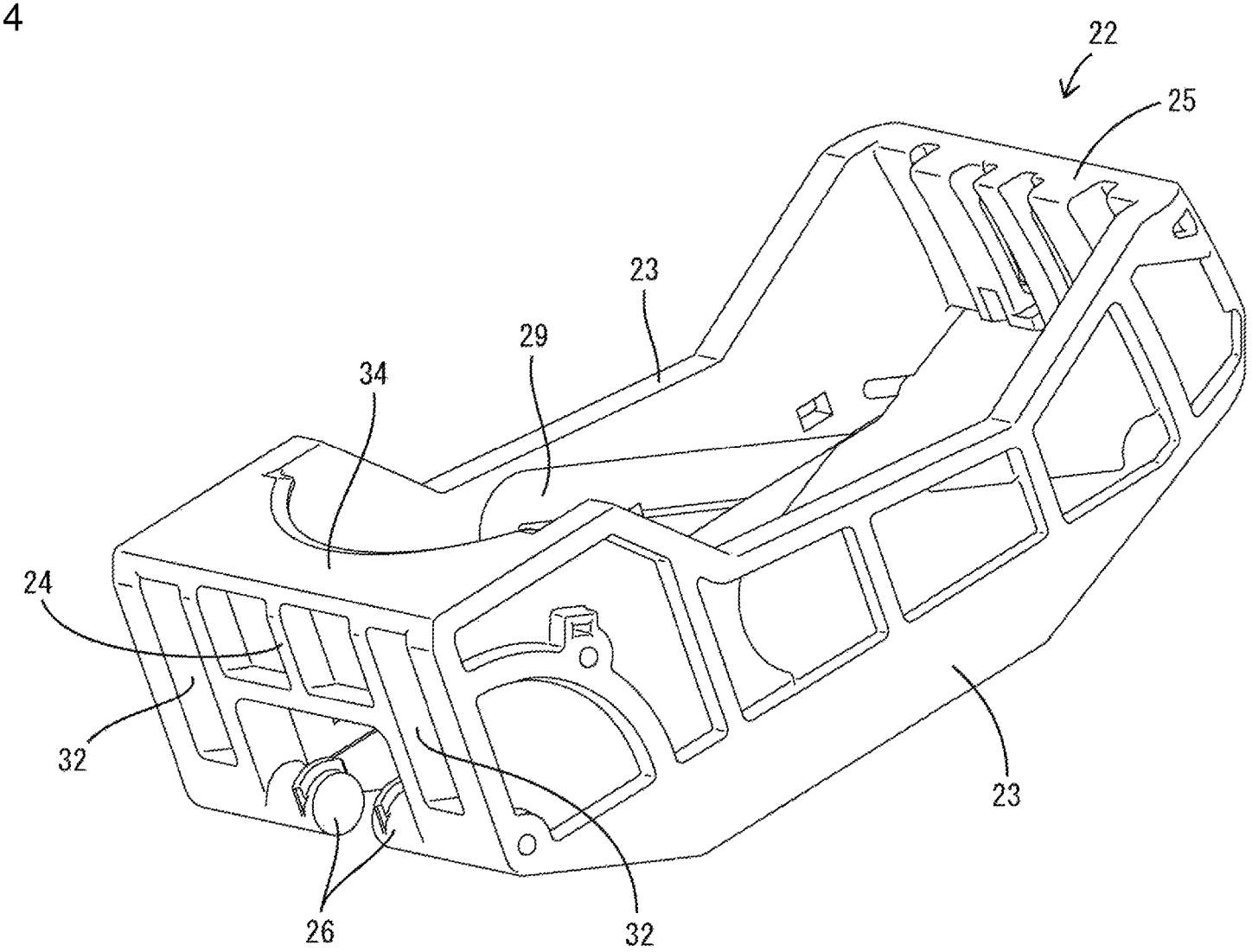
FIG. 14 is a perspective view of the lever.
Figure 15:
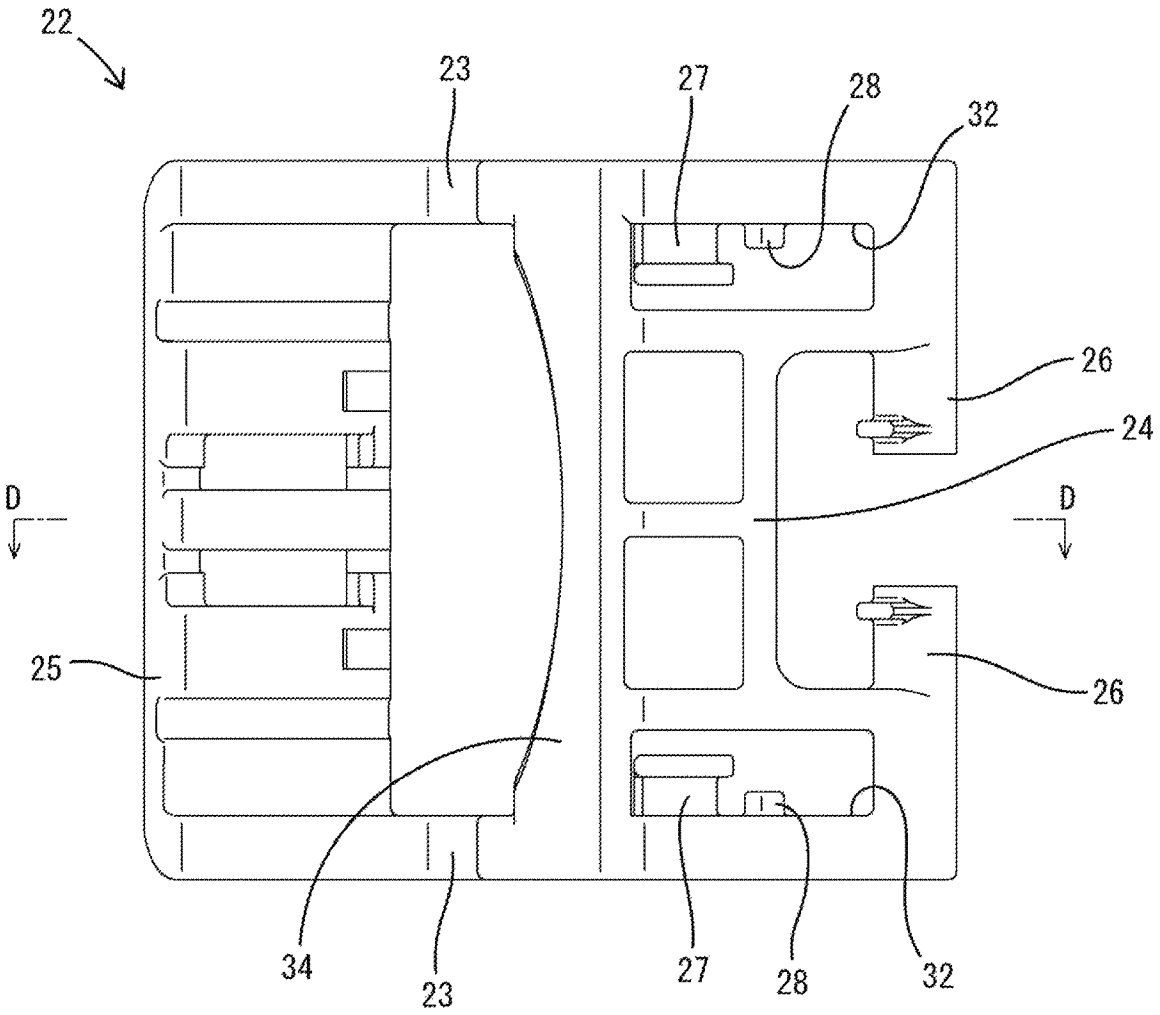
FIG. 15 is a left side view of the lever.
Figure 16:
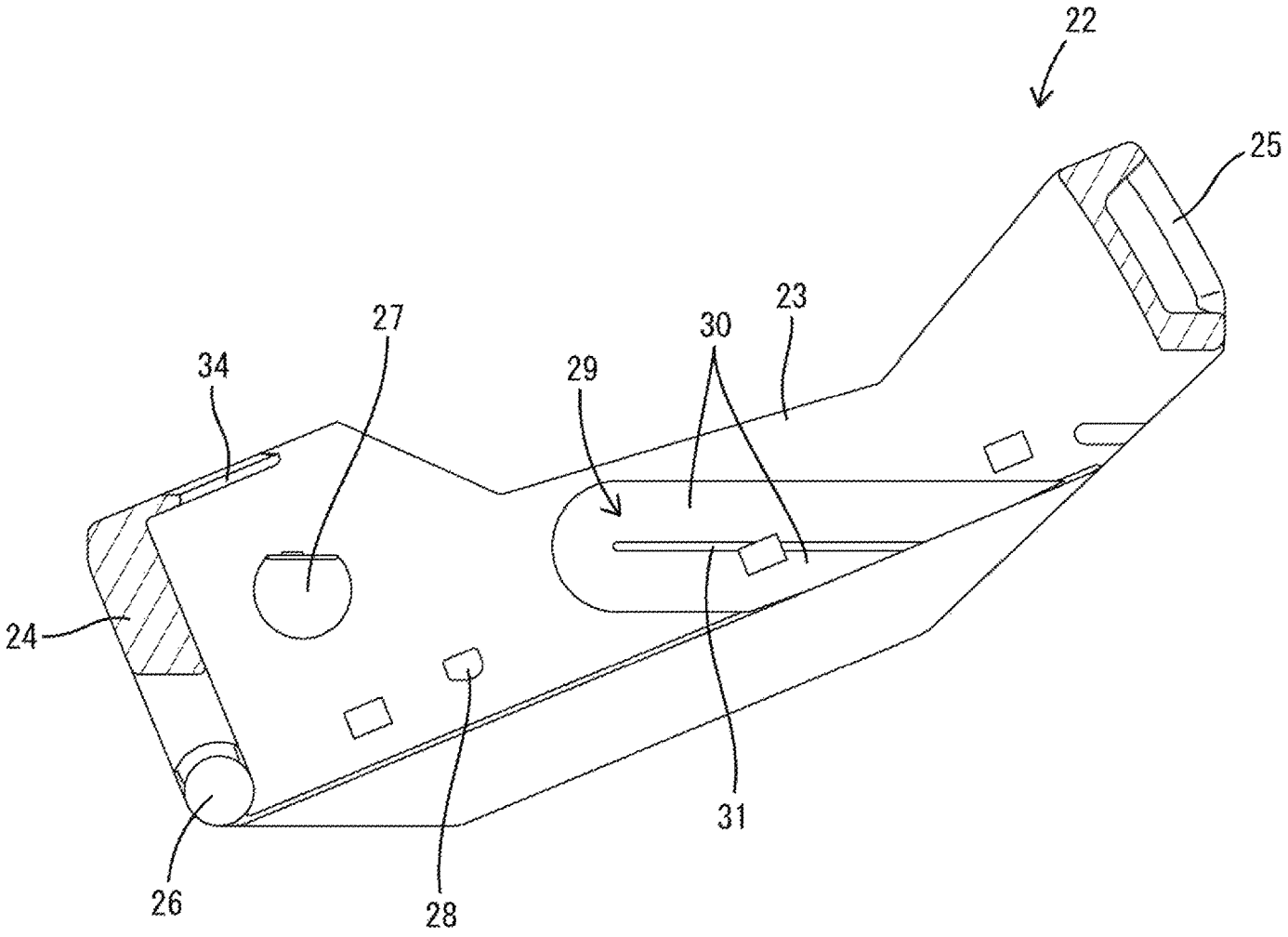
FIG. 16 is a section along D-D of FIG. 15.
Figure 17:
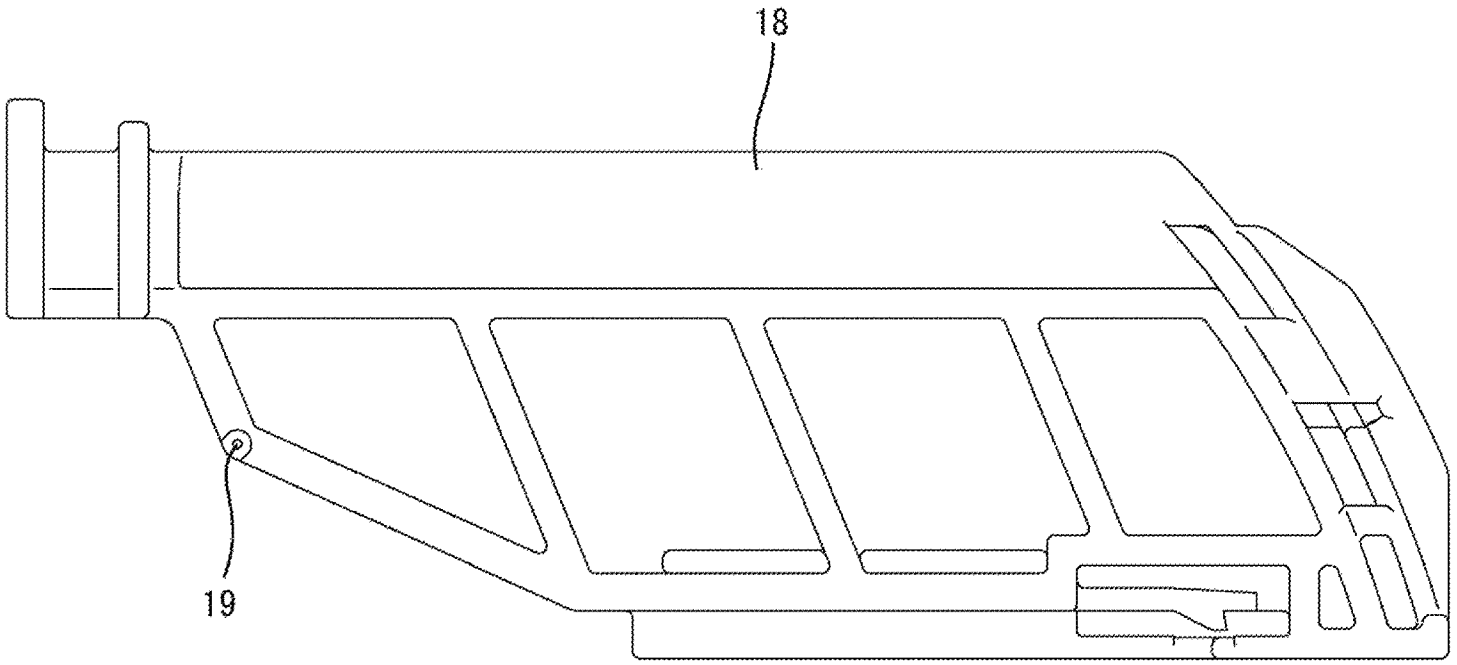
FIG. 17 is a plan view of a wire cover.
Figure 18:
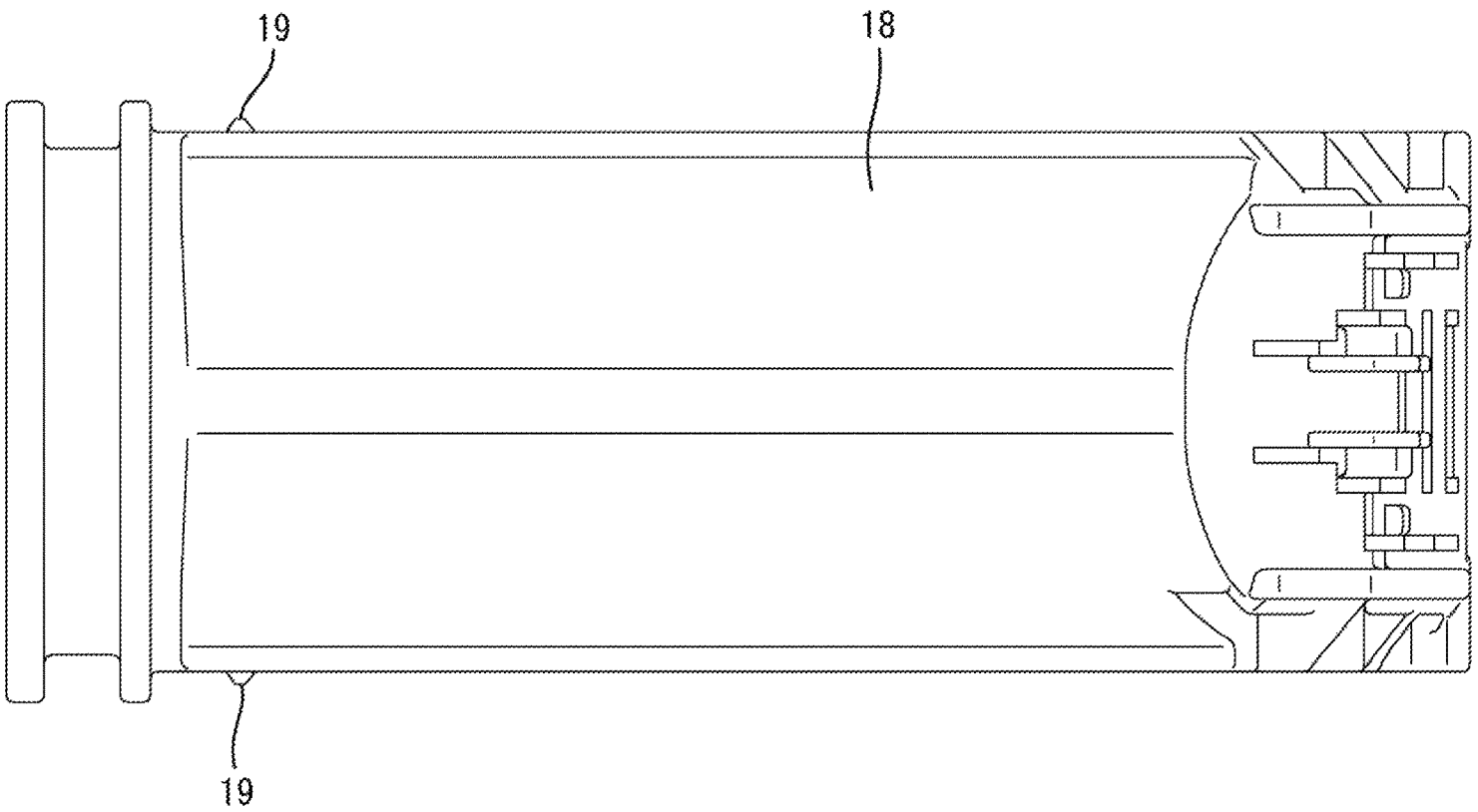
FIG. 18 is a back view of the wire cover.

Two vertically symmetrical locking recesses 29 are formed on the inner surfaces of the upper and lower arms 23. As shown in FIGS. 11 and 16, the locking recess 29 is configured by two gentle slopes 30 oblique to a rotating direction of the lever 22 and connected at an obtuse angle. The gentle slopes 30 are inclined to be substantially parallel to the rotating direction of the lever 22. With the lever 22 at the initial position, the locking projections 19 of the wire cover 18 (first housing 11) are locked to bottom portions 31 of the locking recesses 29.

The coupling 24 has escaping grooves 32 for avoiding interference with left end parts of the sliders 35, including stoppers 44 to be described later. Likewise, the coupling 24 is formed with locking portions 33 projecting inward of the escaping grooves 32 from opening edge parts of the escaping grooves 32. With the lever 22 at the connection position, the locking portions 33 are on a rear end part of the coupling 24. With the lever 22 at the switch position or the initial position, the locking portions 33 are on the left end part of the coupling 24.

The lever 22 is formed with an excessive displacement restricting portion 34 in the form of a plate coupling end parts of the upper and lower arms 23 on the side of the coupling 24. The excessive displacement restricting portion 34 is connected to an end edge part of the coupling 24 on the side of the locking portions 33. With the lever 22 at the switch position or the initial position, the excessive displacement restricting portion 34 faces left end edge parts of the sliders 35 from the left.

<Sliders 35>

The two sliders 35 are vertically symmetrical. Thus, the slider 35 on an upper side is described below and the description of the lower slider 35 is omitted. The slider 35 is a plate having a substantially rectangular plan view shape long in the lateral direction. The slider 35 is mounted in the first housing 11 while being fit into the guide recess 16 with a plate thickness direction aligned with the vertical direction. The slider 35 is movable substantially linearly between a connection start position (see FIGS. 6 and 7) and a connection end position (see FIG. 4). The moving direction of the slider 35 is perpendicular to a connecting/separating direction of the first connector 10 (first housing 11) and the second connector 50 (second housing 51).

The inner surface of the slider 35 faces the connection space 15. Three laterally juxtaposed cam grooves 36 are formed in the inner surface of the slider 35. The entrance of the cam groove 36 is disposed to be open on the front end edge of the slider 35. The entrance and an area connected to the entrance of the cam groove 36 form an entrance-side inclined portion 37. The entrance-side inclined portion 37 is oblique to the connecting/separating direction of the first housing 11 and the second housing 51 and also oblique to the moving direction of the slider 35.

An area of the cam groove 36 to the back of the entrance-side inclined portion 37 forms a force multiplying inclined portion 38. Similar to the entrance-side inclined portion 37, the force multiplying inclined portion 38 is oblique to the connecting/separating direction of the first and second housings 11 and 51 and the moving direction of the slider 35. However, an angle of inclination of the entrance-side inclined portion 37 to the connecting/separating direction (front-rear direction) of the first housing 11 and the second housing 51 is smaller than that of the force multiplying inclined portion 38.

A driven portion 39 is formed on the left end part of the slider 35 and bulges from the upper surface of the slider 35 (outer surface facing the arm portion 23 of the lever 22). The driven portion 39 has a substantially U-shaped driven groove 40 that is open rearward. A surface of the driven portion 39 facing rightward (forward in the moving direction when the slider 35 moves toward the connection end position) defines a driven surface 41 substantially perpendicular to the moving direction of the slider 35. The second driving portion 28 comes into contact with the driven surface 41.

A connecting pressure receiving surface 42 is formed on a right inner surface of the driven groove 40, and a separating pressure receiving surface 43 is formed on a left inner surface of the driven groove 40 (front side in the moving direction when the slider 35 moves toward the connection start position). The first driving portion 27 is accommodated in the driven groove 40. An interval between the connecting pressure receiving surface 42 and the separating pressure receiving surface 43 in the moving direction of the slider 35 exceeds an outer diameter of the first driving portion 27.

The stopper 44 is formed on a left end edge part of the slider 35, which is on the front side in the moving direction when the slider 35 moves toward the connection start position). The stopper 44 has a substantially triangular plan view shape projecting left from a front end part of the left edge of the slider 35. The locking portion 33 of the lever 22 can come into contact with the stopper 44.

<Second Connector 50>

The second connector 50 includes the second housing 51 made of synthetic resin and a male second terminal fittings 55 mounted in the second housing 51. As shown in FIG. 10, the second housing 51 is a single component with a terminal holding portion 52 in the form of a wall and the receptacle 53 in the form of a rectangular tube projecting rearward from the outer peripheral edge of the terminal holding portion 52.

The second terminal fitting 55 is bent into a substantially L shape and a front end part thereof is connected to the circuit board (not shown). A rear end part of the second terminal fitting 55 is accommodated into the receptacle 53 through the terminal holding portion 52. Three laterally juxtaposed cam followers 54 project on each of the outer surfaces of upper and lower walls of the receptacle 53.

<Functions and Effects of Embodiment>

Figure 6:
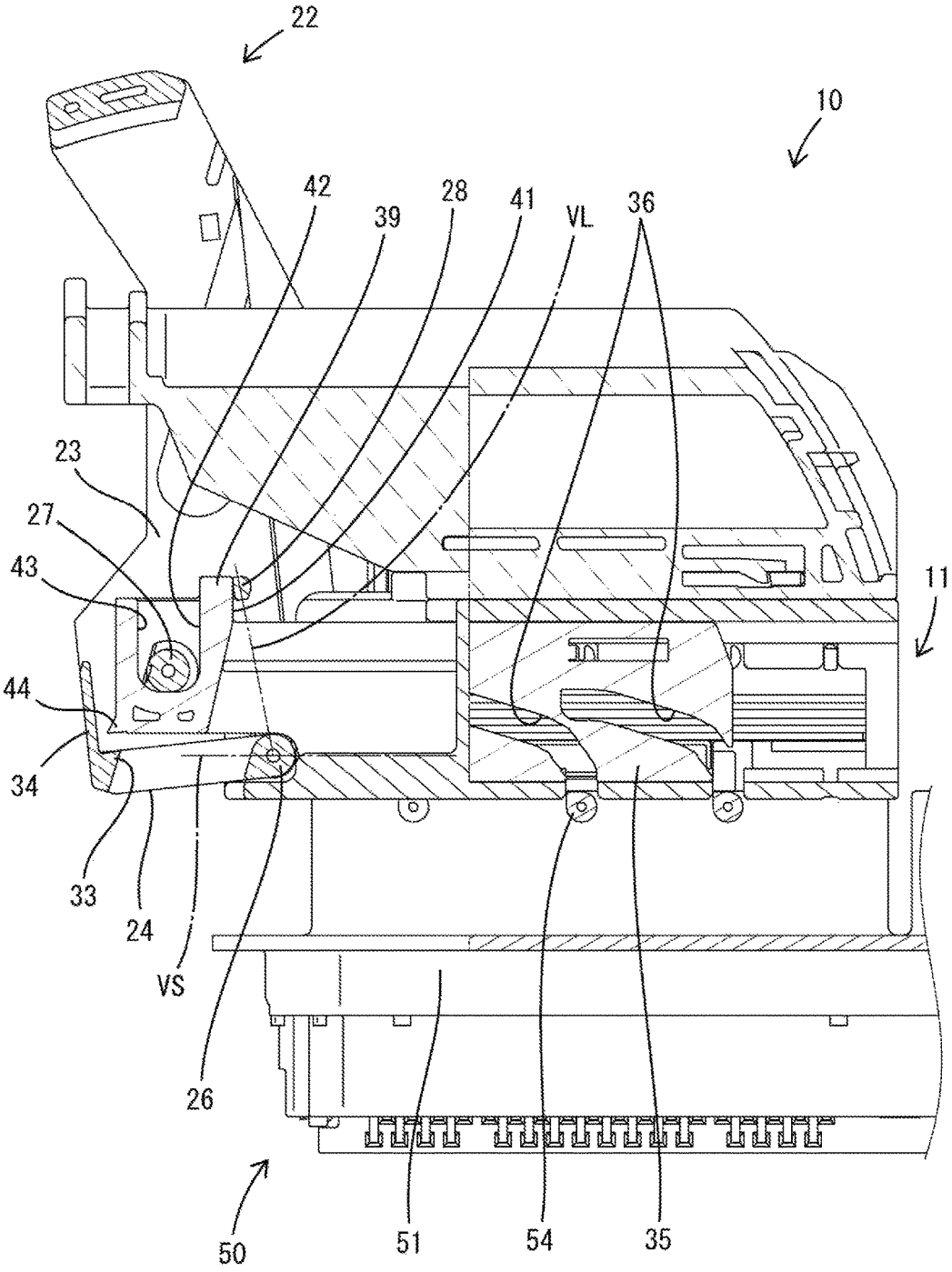
FIG. 6 is a section corresponding to B-B of FIG. 3 showing a state where the lever at the switch position is rotated to an initial position.
Figure 7:
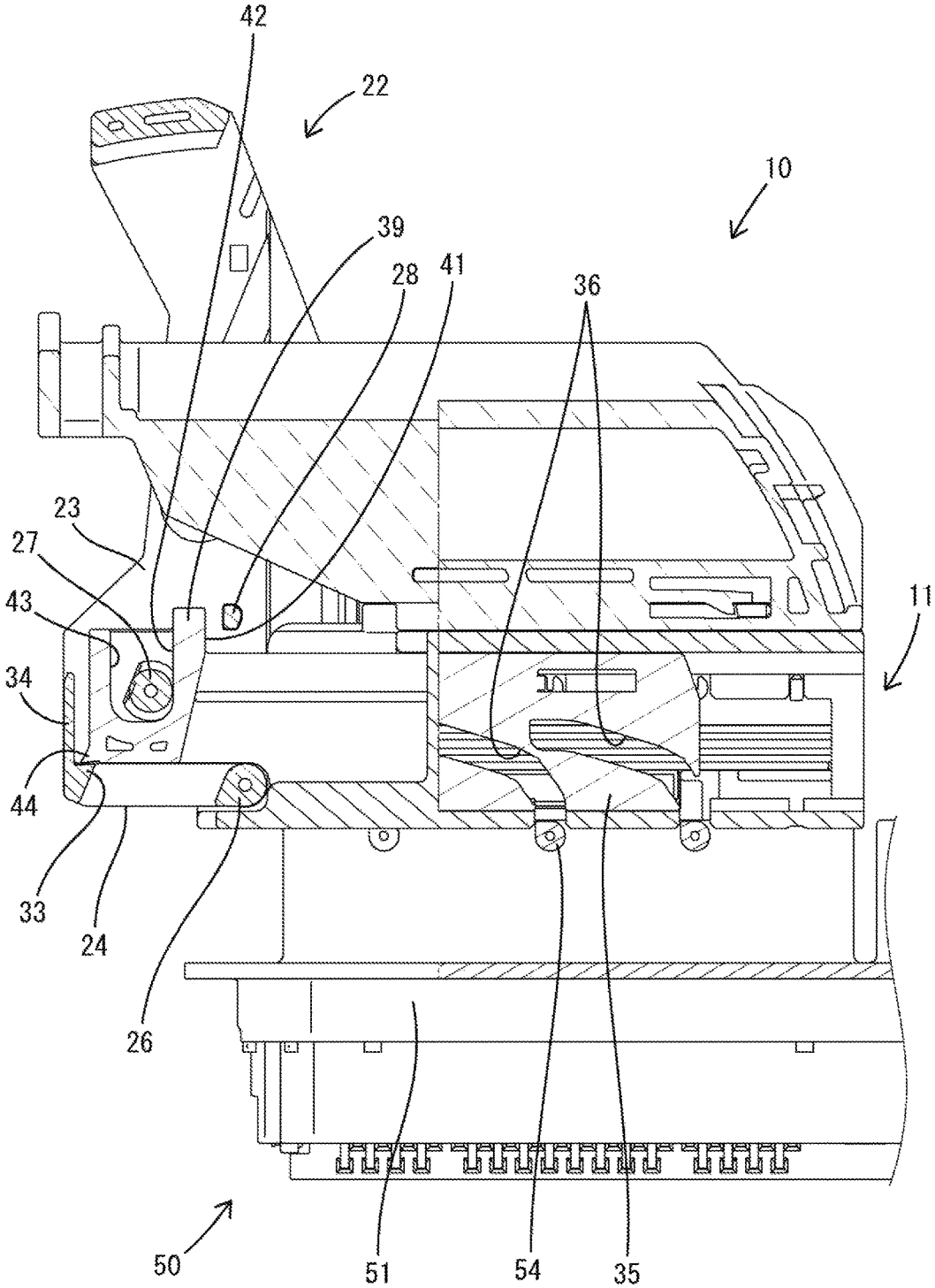
FIG. 7 is a section corresponding to B-B of FIG. 3 showing a state where the lever is rotated from the initial position to the switch position with a slider at a connection start position.

With the first and second connectors 10 and 50 separated, the sliders 35 are held temporarily at the connection start position and the lever 22 is held at the initial position. With the sliders 35 located at the connection start position, the stoppers 44 of the sliders 35 are waiting behind the locking portions 33 of the lever 22 (i.e. before the locking portions 33 in the moving direction when the lever 22 at the initial position or switch position rotates toward the connection position) as shown in FIG. 6. Thus, even if it is attempted to rotate the lever 22 toward the connection position, the locking portions 33 butt against the stoppers 44, as shown in FIG. 7, so that the lever 22 is locked in a state where rotation toward the connection position is restricted.

Figure 8:
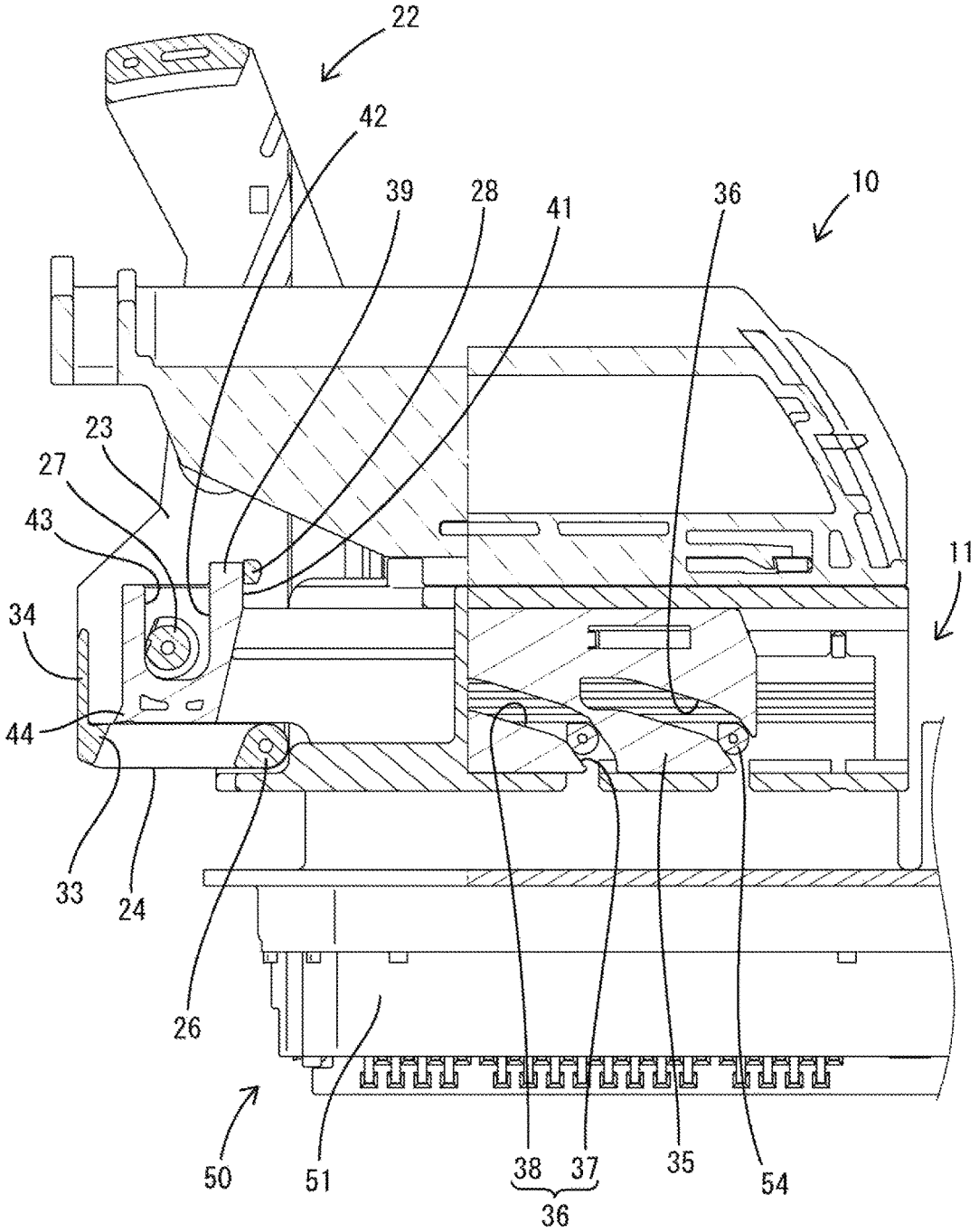
FIG. 8 is a section corresponding to B-B of FIG. 3 showing a state where the slider moves from the connection start position to an unlocking position by lightly connecting the first and second housings.
Figure 9:
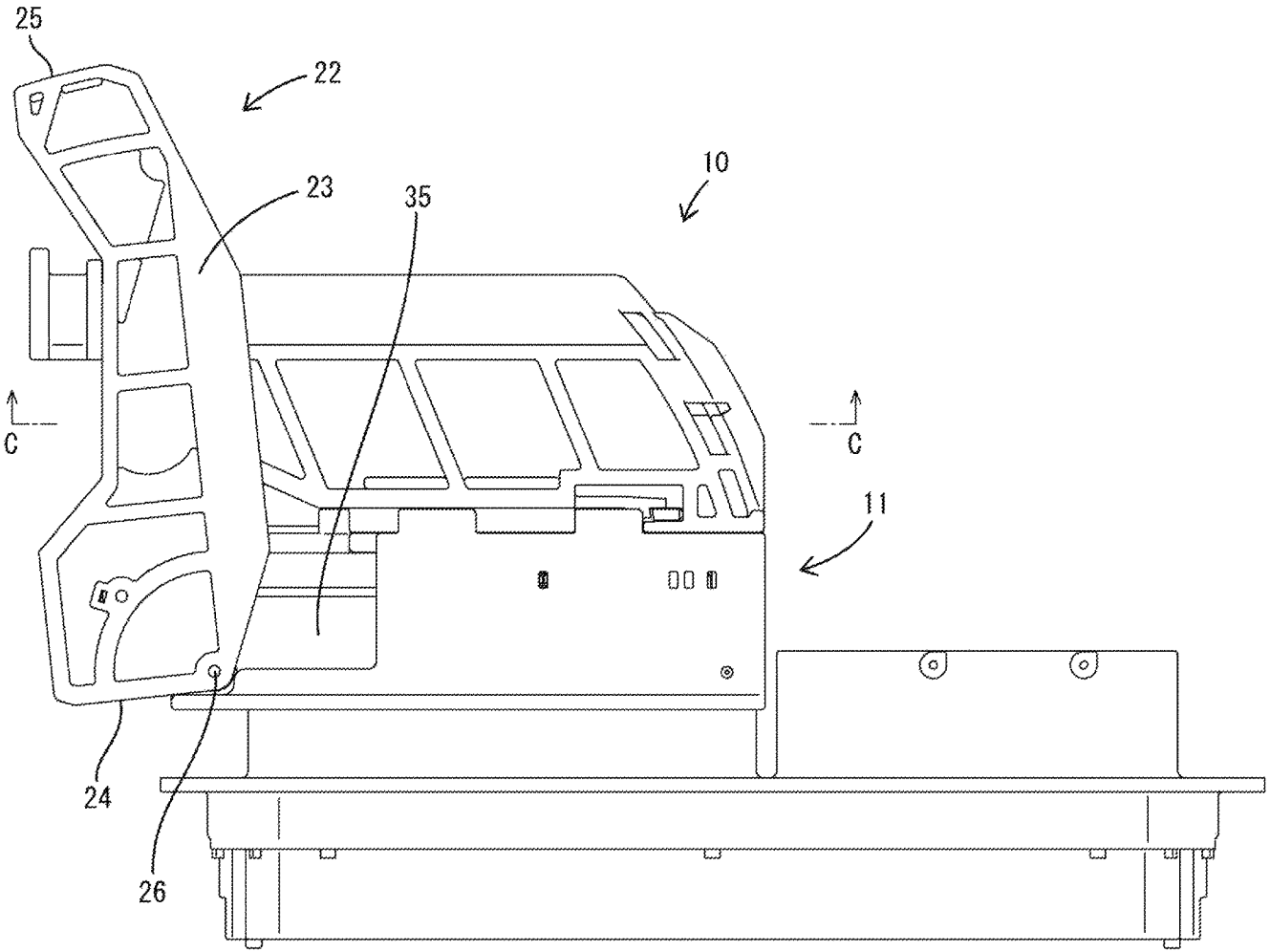
FIG. 9 is a plan view showing a state where the lever is rotated to the initial position from the state where the first and second housings are connected.

When the first and second connectors 10 and 50 are connected from a state where the lever 22 is at the initial position and the sliders 35 are at the connection start position, the first housing 11 and the second housing 51 are connected lightly to fit the inner housing 14 into the receptacle 53, to fit the outer housing 13 externally to the receptacle 53 and to accommodate the receptacle 53 into the connection space 15. Then, as shown in FIG. 8, the cam followers 54 enter the entrances of the cam grooves 36 and press the entrance-side inclined portions 37 so move the sliders 35 from the connection start position to an unlocking position.

The driven surfaces 41 push the second driving portions 28 during this time so that the semi-locking of the locking recesses 29 and the locking projections 19 is released and the lever 22 rotates from the initial position to the switch position. Further, the first driving portions 27 are displaced to approach the separating pressure receiving surfaces 43 while moving away from the connecting pressure receiving surfaces 42 but apply no driving force to the sliders 35. When the sliders 35 move to the unlocking position, the stoppers 44 located to face the locking portions 33 from behind are retracted to positions diagonally behind and to the right of the locking portions 33 (positions deviated rightward from rotation courses of the locking portions 33) as shown in FIG. 8. Thus, the lever 22 is allowed to rotate toward the connection position.

When the lever 22 is rotated toward the connection position from the state where the sliders 35 are at the unlocking position, the first driving portions 27 approach the connecting pressure receiving surfaces 42 while moving away from the separating pressure receiving surfaces 43 in the initial stage of rotation. Thus, until the first driving portions 27 come into contact with the connecting pressure receiving surfaces 42, no driving force is applied to the sliders 35. Note that the second driving portions 28 separated from the sliders 35 and apply no driving force to the sliders 35.

Rotation of the lever 22 causes the first driving portions 27 to press the connecting pressure receiving surfaces 42 rightward. Thus, the sliders 35 move toward the connection end position, and cause the cam followers 54 and the force multiplying inclined portions 38 of the cam grooves 36 to slide in contact. Thus, the first housing 11 is pulled toward the second housing 51 and a connecting operation of the connectors 10, 50 proceeds.

Figure 4:
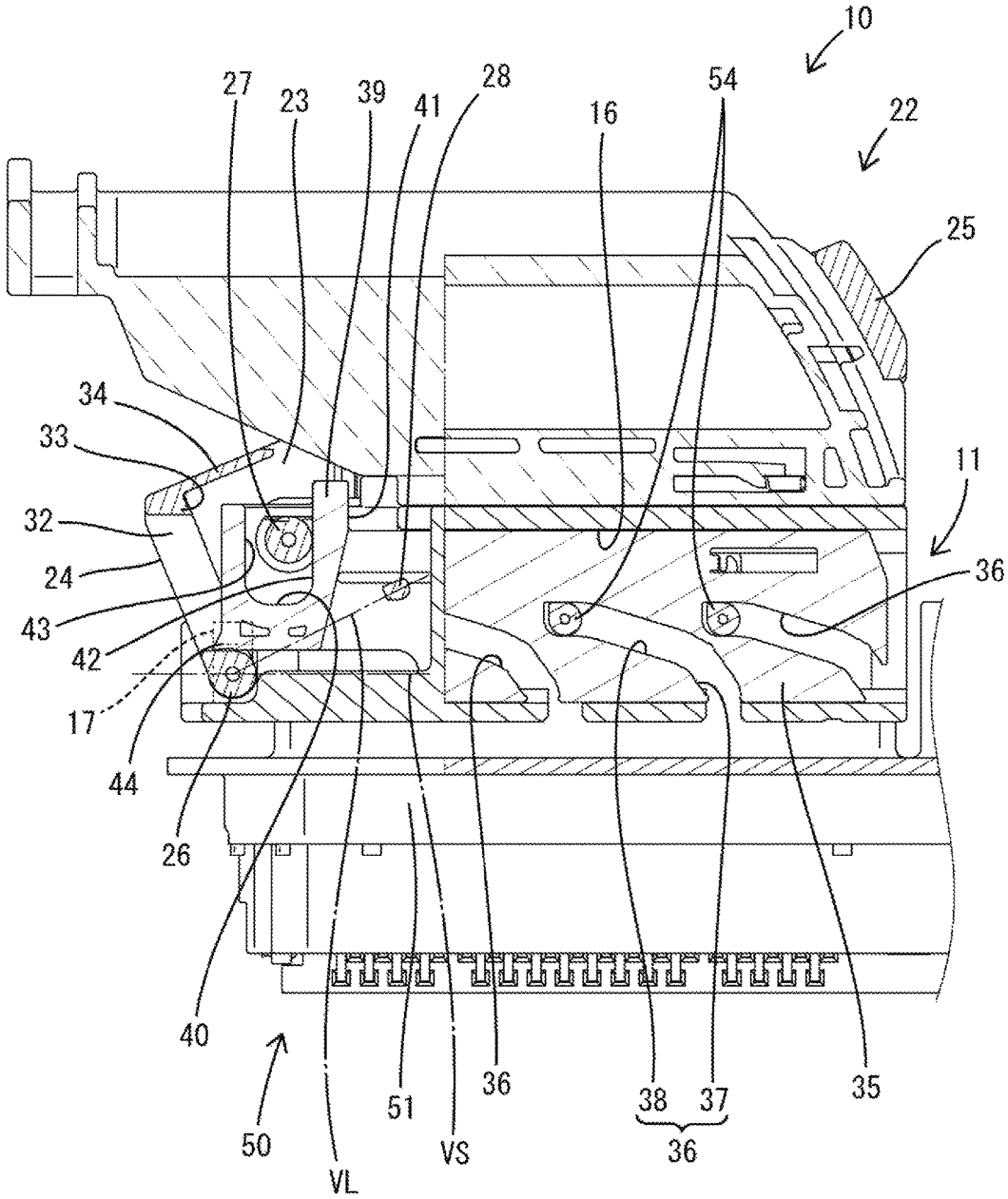
FIG. 4 is a section corresponding to B-B of FIG. 3 showing a connected state of the first and second housings.

When the lever 22 reaches the connection position, as shown in FIG. 4, the sliders 35 reach the connection end position and the housings 11, 51 (both connectors 10, 50) are connected. Note that, in the process of rotating the lever 22 from the switch position to the connection position, the second driving portions 28 move rightward away from the driven portions 39 and apply no driving force to the sliders 35.

The lever 22 is rotated from the connection position to the initial position for separating the connected housings 11, 51. Until the lever 22 reaches the switch position, the first driving portions 27 press the separating pressure receiving surfaces 43 rightward to apply driving forces to the sliders 35. Thus, the sliders 35 move from the connection end position toward the unlocking position. These movements of the sliders 35 moves the first housing 11 away from the second housing 51 by sliding contact between the cam followers 54 and the force multiplying inclined portions 38.

The second driving portions 28 follow and approach the driven portions 39 of the sliders 35 from the right, but apply no driving force to the sliders 35 until the lever 22 reaches the switch position. Further, the locking portions 33 of the lever 22 approach the stoppers 44 of the sliders 35 moving leftward from an oblique left-rear side while drawing an arc. However, the stoppers 44 move only in areas deviated from the rotation courses of the locking portions 33 until the sliders 35 reach the unlocking position. The locking portions 33 do not interfere with the stoppers 44 in this way, and the sliders 35 do not impede a rotational movement of the lever 22.

Figure 5:
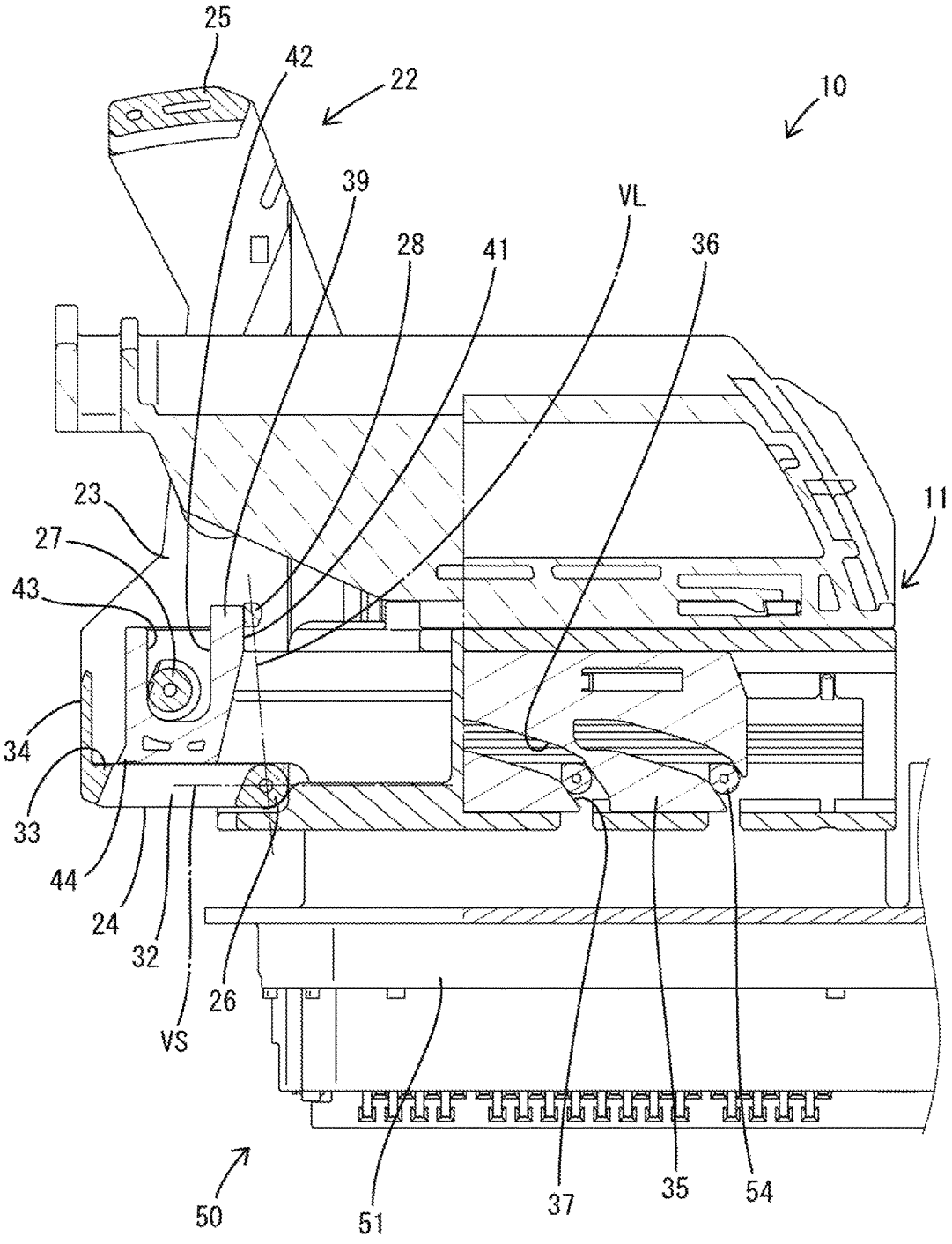
FIG. 5 is a section corresponding to B-B of FIG. 3 showing a state where a lever is rotated to a switch position from the state where the first and second connectors are connected.

When the lever 22 reaches the switch position, the second driving portions 28 contact the driven surfaces 41 at the same time as the sliders 35 reach the unlocking position, as shown in FIG. 5. At this point of time, the connecting operation of the housings 11, 51 has not been completed yet. With the lever 22 at the switch position and the sliders 35 at the unlocking position, a virtual pivot line VL connecting the second driving portion 28 and the rotary shaft 26 of the lever 22 is substantially perpendicular to a vertical reference line VS. The virtual reference line VS is a line passing though the rotary shaft 26 and parallel to the moving direction of the slider 35. Thus, in the process of rotating the lever 22 in an area near the switch position, a displacing direction of the second driving portions 28 is substantially the lateral direction (i.e. direction substantially parallel to the moving direction of the sliders 35). Further, the right ends of the locking portions 33 and the left ends of the stoppers 44 are adjacent in the lateral direction and also adjacent in the front-rear direction.

Rotation of the lever 22 continues after the lever 22 reaches the switch position. In the process of rotating the lever 22 from the switch position to the initial position, the second driving portions 28 press the driven surfaces 41 leftward to apply driving forces to the sliders 35. Thus, the sliders 35 move from the unlocking position to the initial position. During this time, housings 11, 51 are separated farther by sliding contact between the cam followers 54 and the force multiplying inclined portions 38.

While the lever 22 is rotated from the switch position to the initial position, the first driving portions 27 are separated from the connecting pressure receiving surfaces 42 and relatively displaced rightward inside the driven grooves 40, but do not contact the separating pressure receiving surfaces 43. Thus, the first driving portions 27 do not apply driving force to the sliders 35. Further, in the process of rotating the lever 22 from the switch position to the initial position and moving the sliders 35 from the unlocking position to the connection start position, the locking portions 33 are displaced forward away from the stoppers 44 and the stoppers 44 are displaced leftward to approach the locking portions 33.

The separation of the housings 11, 51 is completed when the lever 22 reaches the initial position and the sliders 35 reach the connection start position. The cam followers 54 can come out of the cam grooves 36 in a separation completed state, as shown in FIG. 6. Further, the stoppers 44 face the locking portions 33 from behind. The positions of the stoppers 44 at this time are positions on the rotation courses of the locking portions 33 when the lever 22 is rotated toward the connection position (toward the switch position).

When the lever 22 rotates to the initial position, the bottom portions 31 of the locking recesses 29 of the lever 22 and the locking projections 19 of the first housing 11 are semi-locked. Thus, the lever 22 is held at the initial position. Further, if an external force acts on the lever 22 at the initial position and the lever 22 rotates toward the connection position, the locking portions 33 butt against the stoppers 44 to be locked when the lever 22 reaches the switch position as shown in FIG. 7. Thus, the rotation of the lever 22 toward the connection position is restricted.

The first driving portions 27 contact the connecting pressure receiving surfaces 42 when the lever 22 reaches the switch position. The lever 22 is locked in a rotation restricted state, and therefore the first driving portions 27 apply no driving force to the sliders 35. Further, the sliders 35 and the first housing 11 have semi-locking temporary holding means (not shown) that lock together to keep the sliders 35 at the connection start position. Thus, the sliders 35 are held reliably at the connection start position and the entrances of the cam grooves 36 are held temporarily at positions where the insertion of the cam followers 54 is allowed. Note that, the second driving portions move away from the driven surfaces 41 and apply no driving force to the sliders 35 in the process of rotating the lever 22 from the initial position to the switch position.

The lever-type connector of this embodiment realizes a smooth connection of the first and second housings 11 and 51 and includes the lever 22 and the sliders 35. The lever 22 is mounted on the first housing 11 and is rotatable between the initial position and the connection position. The sliders 35 are mounted in the first housing 11 and move parallel to one another between the connection start position and the connection end position. The slider 35 is formed with the cam grooves 36. The cam followers 54 of the second housing 51 can enter the cam grooves 36 with the sliders 35 at the connection start position. Movement of the sliders 35 from the connection start position to the connection end position causes the cam followers 54 to slide in contact with the cam grooves 36 for connecting the first and second housings 11 and 51.

The lever 22 has the first and second driving portions 27 and 28. In the process of rotating the lever 22 from the connection position to the switch position before the initial position, the first driving portions 27 move the sliders 35 parallel to one another from the connection end position to the unlocking position before the connection start position. In the process of rotating the lever 22 from the switch position to the initial position, the second driving portions 28 push the sliders 35 from the unlocking position to the connection start position.

Further, with the sliders 35 at the connection start position, the second driving portions 28 move away from the sliders 35 as the lever 22 rotates from the initial position to the switch position. Furthermore, the lever 22 is formed with the locking portions 33. With the sliders 35 at the connection start position and the lever 22 at the switch position, the locking portions 33 are locked to the sliders 35 to restrict rotation of the lever 22 toward the connection position.

In separating the first and second housings 11, 51 in the connected state, the lever 22 is rotated from the connection position to the initial position. During this time, the first driving portions 27 move the sliders 35 from the connection end position to the unlocking position until the lever 22 reaches the switch position, and the second driving portions 28 move the sliders 35 to the connection start position according to the rotation of the lever 22 after the sliders 35 reach the unlocking position. That is, driving means for moving the sliders 35 at the switch position toward the connection start position is switched from the first driving portions 27 to the second driving portions 28.

When the lever 22 at the initial position is returned to the switch position after the sliders 35 move to the connection start position, the second driving portions 28 move away from the sliders 35. Therefore, the sliders 35 are kept at the connection start position. When the lever 22 returns to the switch position, the locking portions 33 are locked to the sliders 35 to restrict rotation of the lever 22 toward the connection position. If the rotation of the lever 22 is restricted, the sliders 35 are kept at the connection start position without moving. Thus, the cam grooves 36 wait at positions where the insertion of the cam followers 54 of the second housing 51 is allowed. Thus, according to the lever-type connector of this embodiment, the operation of connecting the first and second housings 11, 51 can be performed smoothly.

Further, the moving direction of the sliders 35 is substantially perpendicular to the connecting/separating direction of the first and second housings 11, 51 and the cam grooves 36 include the entrance-side inclined portions 37. In the process of starting the connection of the first and second housings 11, 51 and inserting the cam followers 54 into the cam grooves 36, pressing forces of the cam followers 54 are applied to the entrance-side inclined portions 37 and the sliders 35 move from the connection start position toward the unlocking position by these pressing forces. According to this configuration, the sliders 35 move to the unlocking position to make the lever 22 rotatable merely by inserting the cam followers 54 into the cam grooves 36. Thus, an operation of returning the sliders 35 to the unlocking position before the insertion of the cam followers 54 into the cam grooves 36 is unnecessary.

Further, the cam grooves 36 are formed with the force multiplying inclined portions 38. In the process of rotating the lever 22 between the switch position and the connection position, the cam followers 54 slide in contact with the force multiplying inclined portions 38. The angle of inclination of the entrance-side inclined portions 37 to the front-rear direction (connecting/separating direction of the first and second housings 11, 51) is smaller than that of the force multiplying inclined portions 38 to the front-rear direction.

The force multiplying inclined portion 38 is an area where a large force is applied toward the cam follower 54 from the slider 35. Thus, a force multiplying function is improved as the angle of inclination to the connecting/separating direction of the housings 11, 51 becomes larger. On the other hand, the entrance-side inclined portion 37 is an area where the pressing force is applied toward the cam groove 36 from the cam follower 54. Thus, the pressing force to the slider 35 can be enhanced as the angle of inclination to the connecting/separating direction of the housings 11, 51 becomes smaller.

Further, the slider 35 is formed with the separating pressure receiving surface 43 to be pushed by the first driving portion 27 in the process of rotating the lever 22 from the connection position to the switch position and the connecting pressure receiving surface 42 to be pushed by the first driving portion 27 in the process of rotating the lever 22 from the switch position to the connection position. The first driving portion 27 is displaceable in the lateral direction (direction parallel to the moving direction of the slider 35) between the separating pressure receiving surface 43 and the connecting pressure receiving surface 42. According to this configuration, the first driving portions 27 apply no driving force to the sliders 35 while rotating the lever 22 from the initial position to the switch position with the sliders 35 at the connection start position, and the sliders 35 can be kept at the connection start position.

Further, the lever 22 is formed with the excessive displacement restricting portion 34. Even if an attempt is made to move the sliders 35 at the connection start position to the left side opposite to the connection end position, the sliders 35 butt against the excessive displacement restricting portion 34. Thus, the sliders 35 do not move to the side opposite to the connection end position. Therefore, excessive rotation of the lever 22 and excessive movements of the sliders 35 can be prevented when separating the first and second housings 11, 51.

Further, the distance between the second driving portion 28 and the rotary shaft 26 serving as a center of rotation of the lever 22 exceeds the distance between the first driving portion 27 and the rotary shaft 26. According to this configuration, in the process of rotating the lever 22 from the switch position to the initial position, a large moving distance of the sliders 35 can be ensured even if an angle of rotation of the lever 22 is small.

Further, the line connecting the rotary shaft 26 serving as the center of rotation of the lever 22 and the second driving portion 28 is defined as the virtual pivot line VL and the line passing through the rotary shaft 26 and parallel to the moving direction of the slider 35 is defined as the virtual reference line VS. In the process of pushing the slider 35 from the unlocking position to the connection start position by the second driving portion 28 (in the process of rotating the lever 22 from the switch position to the initial position), the angle of inclination of the virtual pivot line VL to the virtual reference line VS is in the range larger than 45°.

Specifically, in a state where the lever 22 is rotated from the connection position to the switch position and the second driving portion 28 is in contact with the slider 35, the virtual pivot line VL connecting the second driving portion 28 and the rotary shaft 26 is substantially perpendicular to the virtual reference line VS (direction parallel to the moving direction of the slider 35). Further, in a state where the lever 22 is rotated from the switch position to the initial position and the second driving portion 28 has pushed the slider 35 to the connection start position, the virtual pivot line VL is at an angle substantially close to a right angle to the virtual reference line VS.

If the angle of inclination of the virtual pivot line VL to the virtual reference line VS is smaller than 45° in the process of pushing the slider 35 from the unlocking position to the connection start position by the second driving portion 28, a moving distance of the second driving portion 28 in a direction parallel to the moving direction of the slider 35 is shorter than a moving distance of the second driving portion 28 in a direction perpendicular to the moving direction of the slider 35. Thus, even if the angle of rotation of the lever 22 is large, the moving distance of the slider 35 is relatively short.

In contrast, in this embodiment, the angle of inclination of the virtual pivot line VL to the virtual reference line VS is larger than the 45° in the process of pushing the slider 35 from the unlocking position to the connection start position by the second driving portion 28. If the second driving portion 28 is rotated in the range where the angle of inclination of the virtual pivot line VL to the virtual reference line VS is larger than 45°, the moving distance of the second driving portion 28 in the direction parallel to the moving direction (virtual reference line VS) of the slider 35 is longer than the moving distance of the second driving portion 28 in the direction perpendicular to the moving direction of the slider 35. Thus, even if the angle of rotation of the second driving portion 28 is small when the lever 22 is rotated from the switch position to the initial position, a long moving distance can be ensured.

Further, the lever 22 is formed with the locking recesses 29 each configured by two gentle slopes 30 oblique to the rotating direction of the lever 22 and connected at an obtuse angle. On the other hand, the first housing 11 is formed with the locking projections 19 to be locked to the bottom portions 31 of the locking recesses 29 with the lever 22 located at the initial position.

According to this configuration, the lever 22 can be held at the initial position by locking the locking projections 19 and the locking recesses 29. Since each locking recess 29 is configured by the two gentle slopes 30 connected at an obtuse angle, the locking recesses 29 and the locking projections 19 are semi-locked. Thus, workability is good in rotating the lever 22 from the initial position toward the connection position.

The invention is not limited to the above described and illustrated embodiment. For example, the following embodiments also are included in the scope of the invention.

Although the slider moves from the connection start position to the unlocking position to make the lever rotatable only by inserting the cam followers into the entrances of the cam grooves in the above embodiment, the slider may be returned to the unlocking position before the cam followers are inserted into the cam grooves.

Although the angle of inclination of the force multiplying inclined portions to the connecting/separating direction of the first and second housings is larger than that of the entrance-side inclined portions in the above embodiment, the entrance-side inclined portions and the force multiplying inclined portions may have the same angle of inclination.

Although the distance between the rotary shaft and the second driving portion is set longer than the distance between the rotary shaft and the first driving portion in the above embodiment, the distance between the rotary shaft and the second driving portion may be shorter than or equal to the distance between the rotary shaft and the first driving portion.

Although the virtual pivot line connecting the second driving portion and the rotary shaft of the lever is substantially perpendicular to the moving direction of the slider in the state where the lever is rotated from the connection position to the switch position and the second driving portion is in contact with the slider in the above embodiment, the virtual pivot line may extend in a direction at a relatively large angle to the moving direction of the slider.

In the above embodiment, the line connecting the rotary shaft of the lever and the second driving portion is defined as the virtual pivot line, the line passing through the rotary shaft and parallel to the moving direction of the slider is defined as the virtual reference line, and the angle of inclination of the virtual pivot line to the virtual reference line in the process of pushing the slider by the second driving portion is limited to the range larger than 45°. However, there is no limitation to this and the angle of inclination of the virtual pivot line to the virtual reference line in the process of pushing the slider by the second driving portion may be in a range smaller than 45°.

LIST OF REFERENCE SIGNS

11 . . . first housing
19 . . . locking projection
22 . . . lever
26 . . . rotary shaft
27 . . . first driving portion
28 . . . second driving portion
29 . . . locking recess
30 . . . gentle slope
31 . . . bottom portion of locking recess
33 . . . locking portion
34 . . . excessive displacement restricting portion
35 . . . slider
36 . . . cam groove
37 . . . entrance-side inclined portion
38 . . . force multiplying inclined portion
42 . . . connecting pressure receiving surface
43 . . . separating pressure receiving surface
51 . . . second housing
54 . . . cam follower
VL . . . virtual pivot line
VS . . . virtual reference line

What is claimed is:

1. A lever-type connector, comprising:

a first housing;

a second housing connectable to and separable from the first housing;

a lever mounted on the first housing and rotatable between an initial position and a connection position;

a slider mounted in the first housing and movable between a connection start position and a connection end position;

a cam groove formed in the slider and configured to allow insertion of a cam follower formed on the second housing with the slider located at the connection start position and connect the first housing and the second housing by causing the cam follower to slide in contact therewith in the process of moving the slider from the connection start position to the connection end position;

a first driving portion formed on the lever and configured to move the slider from the connection end position to an unlocking position before the connection start position in the process of rotating the lever from the connection position to a switch position before the initial position;

a second driving portion formed on the lever and configured to push the slider from the unlocking position to the connection start position in the process of rotating the lever from the switch position to the initial position and move away from the slider as the lever is rotated from the initial position to the switch position with the slider located at the connection start position; and a locking portion formed on the lever and configured to restrict rotation of the lever toward the connection position by being locked to the slider with the slider located at the connection start position and the lever located at the switch position.

2. The lever-type connector of claim 1, wherein the cam groove includes an entrance-side inclined portion capable of moving the slider from the connection start position toward the unlocking position by a pressing force of the cam follower in the process of starting connection of the first housing and the second housing and inserting the cam follower into the cam groove.

3. The lever-type connector of claim 2, wherein:

the cam groove is formed with a force multiplying inclined portion configured to cause the cam follower to slide in contact therewith in the process of rotating the lever between the switch position and the connection position; and an angle of inclination of the force multiplying inclined portion to a connecting/separating direction of the first housing and the second housing is set larger than that of the entrance-side inclined portion.

4. The lever-type connector of claim 1, wherein:

the slider is formed with a separating pressure receiving surface to be pushed by the first driving portion in the process of rotating the lever from the connection position to the switch position and a connecting pressure receiving surface to be pushed by the first driving portion in the process of rotating the lever from the switch position to the connection position; and the first driving portion is displaceable in parallel to a moving direction of the slider between the separating pressure receiving surface and the connecting pressure receiving surface.

5. The lever-type connector of claim 1, comprising an excessive displacement restricting portion formed on the lever and configured to restrict a movement of the slider at the connection start position toward a side opposite to the connection end position.

6. The lever-type connector of claim 1, wherein a distance between the second driving portion and a rotary shaft serving as a center of rotation of the lever is longer than a distance between the first driving portion and the rotary shaft.

7. The lever-type connector of claim 1, wherein:

a line connecting a rotary shaft serving as a center of rotation of the lever and the second driving portion is defined as a virtual pivot line and a line passing through the rotary shaft and parallel to a moving direction of the slider is defined as a virtual reference line; and an angle of inclination of the virtual pivot line to the virtual reference line is larger than 45° in the process of pushing the slider from the unlocking position to the connection start position by the second driving portion.

8. The lever-type connector of claim 1, comprising:

a locking recess formed in the lever and configured by two gentle oblique to a rotating direction of the lever and connected at an obtuse angle; and a locking projection formed on the first housing and configured to be locked to a bottom portion of the locking recess with the lever located at the initial position.

* * * * *